US008293698B2

(12) United States Patent
Le Coent et al.

(10) Patent No.: US 8,293,698 B2
(45) Date of Patent: Oct. 23, 2012

(54) ALKYLARYL SULFONATE DETERGENT MIXTURE DERIVED FROM LINEAR OLEFINS

(75) Inventors: Jean-Louis Le Coent, Le Havre (FR); Pierre Tequi, Breaute (FR)

(73) Assignee: Chevron Oronite S.A., Gonfreville-l Orcher (FR)

( * ) Notice: Subject to any disclaimer, the term of this patent is extended or adjusted under 35 U.S.C. 154(b) by 1077 days.

(21) Appl. No.: 11/186,158

(22) Filed: Jul. 20, 2005

(65) Prior Publication Data

US 2007/0021317 A1 Jan. 25, 2007

(51) Int. Cl.
*C11D 17/00* (2006.01)

(52) U.S. Cl. ..... 510/424

(58) Field of Classification Search ..... 510/424
See application file for complete search history.

(56) References Cited

U.S. PATENT DOCUMENTS

| | | | |
|---|---|---|---|
| 3,494,971 | A | 2/1970 | Fenske et al. |
| 4,235,810 | A | 11/1980 | Osselet et al. |
| 4,301,316 | A | 11/1981 | Young |
| 5,276,231 | A | 1/1994 | Kocal et al. |
| 5,939,594 | A | 8/1999 | Le Coent |
| 6,054,419 | A | 4/2000 | Le Coent |
| 6,169,219 | B1 | 1/2001 | Kojima et al. |
| 6,204,226 | B1 | 3/2001 | Le Coent et al. |
| 6,269,881 | B1 | 8/2001 | Chou et al. |
| 6,337,310 | B1 | 1/2002 | Campbell et al. |
| 6,476,282 | B1 | 11/2002 | Le Coent |
| 6,479,440 | B1 | 11/2002 | Le Coent |
| 6,551,967 | B2 | 4/2003 | King et al. |
| 6,589,927 | B1 | 7/2003 | Kott et al. |
| 6,849,588 | B2 | 2/2005 | Elsik et al. |
| 2004/0248996 | A1 * | 12/2004 | Costello et al. ..... 516/58 |

FOREIGN PATENT DOCUMENTS

| | | | |
|---|---|---|---|
| EP | 0 368 622 | A2 | 5/1990 |
| EP | 0 976 810 | A1 | 2/2002 |
| WO | WO 2004/113478 | A1 | 12/2004 |
| WO | 2005/018300 | A2 | 3/2005 |

* cited by examiner

*Primary Examiner* — Ling Choi
*Assistant Examiner* — Thuy-Ai Nguyen

(57) ABSTRACT

Disclosed are detergent mixtures of alkyl aryl sulfonates of alkaline earth metals derived from linear olefins having a relatively high aryl ring attached on positions 1 or 2 or the linear alkyl chains. The compositions contain a relatively high amount of 1 or 2 tolyl or xylyl isomer of the linear alkylaryl sulfonate and employ a heavy alkyl benzene sulfonate derived from linear olefins and exhibit improved stability and compatibility.

23 Claims, No Drawings

ALKYLARYL SULFONATE DETERGENT MIXTURE DERIVED FROM LINEAR OLEFINS

FIELD OF THE INVENTION

The present invention relates to oil soluble alkylaryl sulfonate detergent mixtures derived from linear olefins. The compositions contain a relatively high amount of 1 or 2 tolyl or xylyl isomer of the linear alkylaryl sulfonate and employ a heavy alkyl benzene sulfonate derived from linear olefins.

BACKGROUND OF THE INVENTION

In the prior art, methods are known for preparing weakly or strongly superalkalinized sulfonates from sulfonic acids obtained by the sulfonation of different alkyl aryl hydrocarbons and from an excess of alkaline earth metal base. These compounds are useful detergents when employed in a lubrication oil composition. The alkyl aryl hydrocarbons subjected to the sulfonation reaction are obtained by alkylation via the Friedel and Craft reaction of different aryl hydrocarbons, particularly aromatics with two different types of olefin; namely, branched olefins and linear olefins. Typically, branched olefins are obtained by the oligo polymerization of propylene to $C_{15}$ to $C_{42}$ hydrocarbons, particularly the propylene tetrapolymer dimerized to an average of $C_{24}$ olefin. The useful linear olefins typically are obtained by the oligopolymerization of ethylene to $C_{14}$ to $C_{40}$ hydrocarbons.

While it is relatively easy to obtain a good dispersion in the medium of alkaline earth base not fixed in the form of salt if the sulfonic acid is derived from a hydrocarbon obtained by alkylation of an aryl hydrocarbon with a branched olefin. It is difficult if the alkylation is effected with a linear olefin. It is particularly difficult for the alkylation of an aryl hydrocarbon where it is monoalkyl and where a high percentage of the alkyl aryl hydrocarbons have the aryl substituent on positions 1 and 2 of the linear alkyl chain due to the formation of a skin in the open air. This poor dispersion is more pronounced if the medium also contains a high proportion of sulfonate, that is if it corresponds, according to ASTM D-2896, to a low base number (BN between 3 and 60), hence to a low content of free lime and the absence of carbon dioxide and carbonate.

In fact, the alkylation reaction between benzene in a large molar excess and another aromatic or aryl hydrocarbons around 25 mole % of the alkyl aryl hydrocarbon has the aryl substituent on positions 1 and 2 of the linear alkyl chain but displays an undesirable characteristic. When prepared by the method described, for example in U.S. Pat. No. 4,764,295, this high proportion alkyl aryl hydrocarbon having an aryl radical on position 1 or 2 of the linear alkyl chain results in a sulfonate that exhibits hygroscopic properties such that as superficial "skin" is formed. This "skin" makes this product unacceptable as an additive for lubricating oil. Furthermore, the formation of the superficial skin is generally accompanied by a very low filtration rate, a high viscosity, a low incorporation of calcium, a deterioration of anti-rust performance, and an undesirable turbid appearance or even sedimentation, when the sulfonate thus prepared is added at the rate of 10% by weight to a standard lubricating oil and stored for examination. Although a high proportion of the aryl substituent on positions 1 and 2 of the linear alkyl chain provides some performance benefits, the formation of the "skin" has limited its application.

To study this phenomenon, the applicant has carried out chromatographic analyses to identify each of the different isomers differing by the position of the aryl radical on the carbon atom of the linear alkyl chain and examined their respective influence on the properties of the corresponding alkyl aryl sulfonates of alkaline earth metals obtained from these different isomers.

In U.S. Pat. No. 5,939,594, the applicant has thus discovered that he could overcome the aforementioned drawbacks in as much as the mole % of the aryl hydrocarbon, other than benzene, having the aryl substituent on position 1 or 2 of the linear alkyl chain was between 0 and 13% and particularly between 5 and 11% and more particularly between 7 and 10%. However, such a process has some drawbacks: for example, benzene could not be used as the aryl hydrocarbon—since it leads to the formation of the skin, and if alkylation was conducted through a HF process, a staggered reaction (two reactors in series) was required. Therefore, if alkylation was conducted through a fixed bed process, two reactors were also required: an isomerization reactor in order to decrease the level of double bound between carbons 1 and 2 down to less than 13% and then a alkylation reactor. Such afore mentioned process has at least two drawbacks: chlorine is utilized and two reactors are required for the alkylation reaction.

In U.S. Pat. No. 6,204,226, the applicant has discovered that he could overcome the aforementioned drawbacks (avoid the necessity of having two reactors at alkylation step and the chlorine) with the use of benzene as aromatic hydrocarbon by employing the following mixture of alkaline earth metals having:

a) from 20% to 70% by weight of a linear mono alkyl phenyl sulfonate in which the linear mono alkyl substituent contains from 14 to 40 carbon atoms, preferably from 20 to 40 carbon atoms, and the mole % of the phenyl sulfonate radical fixed on position 1 or 2 of the linear alkyl chain is between 10% and 25% preferably between 13% and 20% and, b) from 30% to 80% by weight of a branched mono alkyl phenyl sulfonate in which the branched mono alkyl substituent contains from 14 to 18 carbon atoms.

However, due to the high content of linear mono alkyl phenyl sulfonate substituted in position 1 or 2 of the linear alkyl chain, a large quantity of branched mono alkyl phenyl sulfonate in which the branched mono alkyl substituents contain from 14 to 18 carbon atoms was required to avoid skin formation and moisture sensitivity, but as the average molecular weight and the level of linear mono alkyl phenyl sulfonate having a $C_{14}$ to $C_{40}$ linear alkyl chain is too low, some performances such as solubility in a severe formulation and skin formation in the open air after 20 days, decrease.

Similarly, in U.S. Pat. No. 6,054,419 the applicant has discovered that he could overcome the aforementioned drawbacks with the use of benzene as an aromatic hydrocarbon by increasing the level of total linear mono alkyl sulfonate having a $C_{14}$ to $C_{40}$ linear chain due to the fact that the molar proportion of the phenyl sulfonate substituent in position 1 or 2 is decreased. From preferably between 10 to 25% to down to 0% to 13%. Through the mixture of alkyl aryl sulfonates of superalkalinized alkaline earth metal comprising:

a) 50 to 85% by weight of a mono phenyl sulfonate with a $C_{14}$ to $C_{40}$ linear chain wherein the molar proportion of phenyl sulfonate substituent in position 1 or 2 is between 0 and 13% and, b) 15 to 50% by weight of heavy alkyl aryl sulfonate, wherein the aryl radical is phenyl or not and the alkyl chain are either two linear alkyl chains with a total number of carbons of 16 to 40 or one or a plurality of branched alkyl chain with on average a total number of carbon atoms of 15 to 48.

In as much as theses mixtures contain less than 10% of linear mono alkyl phenyl sulfonate substituted in position 1 or 2 of the linear alkyl chain, they avoid the "skin" formation and do not display too much sensibility to water. But as the level of total linear mono alkyl phenyl sulfonates (having a $C_{14}$ to $C_{40}$ linear alkyl chain) decreases, some performances such thermal stability at 80° C., solubility in severe formulations also correspondingly decreases. Moreover, this application has 2 drawbacks, the use of benzene which is more toxic than toluene or xylene, the necessity of two reactors at alkylation step.

The structure of the alkylates (linear and long alkyl chain) which give a high mole percentage of aryl sulfonate radical in position 1 or 2 of the linear alkyl chain is important for improvement of compatibility, solubility, thermal stability, foaming, dispersion and reduction of sediment in the final package where alkyl aryl sulfonates are mixed with sulfurized overbased alkylphenates. Therefore, there remains a need to develop oil soluble detergent mixture having a high mole percentage or the aryl sulfonate radical in position 1 or 2 or the linear chain, which does not quickly develop an unacceptable skin, mitigates the health issues and improves the solubility and compatibility of the detergent mixture.

SUMMARY OF THE INVENTION

The present invention is directed in part to a detergent mixture which overcomes many of the issues identified above. More particularly, it is directed to a detergent mixture of alkyl aryl sulfonates of alkaline earth metals comprising:

a) 50 to 90% by weight of a mono $C_{14}$ to $C_{40}$ linear alkyl substituted tolyl or xylyl sulfonate, wherein from 15 to 30 mole % of the tolyl or xylyl ring is attached on positions 1 or 2 of the linear alkyl chain;

b) 10 to 50% by weight of a heavy alkyl benzene sulfonate derived from alkylation of benzene with $C_{10}$ to $C_{14}$ linear olefin, wherein heavy benzene sulfonate is selected from:

i) dialkyl benzene sulfonate, ii) monoalkyl benzene sulfonate, wherein the alkyl substituent is derived from the dimerization of the linear olefin, and iii) mixtures of i) and ii).

Another aspect of the invention is directed to lubricating compositions containing a major amount of oil of lubricating viscosity and a minor amount of detergent mixture described above. Detergent concentrates can also be prepared by employing an organic diluent in place of the oil of lubricating viscosity.

The $C_{14}$ to $C_{40}$ linear alkyl is typically a blend of carbon cuts, which depend in part on the process that it employed to prepare it. Thus, both narrow and wide carbon distributions are available. Particularly preferred linear alkyl contain from about 16 to 30 carbons and more preferably form 20 to 24 carbon atoms.

Surprisingly, the detergent mixture can have a large amount of the tolyl or xylyl ring is attached on positions 1 or 2 of the linear alkyl chain; preferably from 18 to 25 mole %, and even more preferably from 20 to 25 mole % of tolyl or xylyl ring is attached on positions 1 or 2 of the linear alkyl chain; without exhibiting stability or compatibility problems. This interaction appears to be due to the particular selection of heavy alkyl benzene sulfonate derived from alkylation of benzene with $C_{10}$ to $C_{14}$ linear olefin. Other combinations do not share this synergy.

Particularly preferred detergent mixtures of the invention preferably contain from 60 to 80% by weight of component a) define above and from 20 to 20% by weight of component b) defined above. Preferably, the base No. of the detergent mixture as measured according to Standard ASTM-D-2896 is from 3 to 60 and more preferably from 10 to 40.

In fact, said mixture exhibits a set of properties of solubility in the lubricating oil, filtration rate, viscosity, dispersion of impurities (carbonaceous particles) incorporation of alkaline earth metal in the medium, thermal stability at 80° C., an absence of turbidity and an absence of the formation of a superficial skin after a storage of 3 days in an open beaker at room temperature, which makes them particularly attractive as detergent/dispersant lubricating oil compositions

DETAILED DESCRIPTION OF THE INVENTION

In its broadest aspect, the present invention involves a mixture of alkyl aryl sulfonates of alkaline earth metals, its application as detergent/dispersant additives for lubricating oils, and methods for preparing said mixture. Prior to discussing the invention in further detail, the following terms will be defined:

Definitions

As used herein the following terms have the following meanings unless expressly stated to the contrary:

The term "alkaline earth alkylaryl sulfonate" refers to an alkaline earth metal salt of an alkylaryl sulfonic acid. In other words, it is an alkaline earth metal salt of an aryl, tolyl or xylyl, etc., that is substituted with (1) an alkyl group and (2) a sulfonic acid group that is capable of forming a metal salt.

The term "alkaline earth metal" refers to calcium, barium, magnesium, and strontium.

The term "the mole % of the aryl, tolyl or xylyl sulfonate radical fixed on position 1 or 2 of the linear alkyl chain" refers to the mole percentage of all the aryl, tolyl or xylyl sulfonate radicals fixed on the linear alkyl chain that are fixed at the first and second position of the linear alkyl chain. The first position of the linear chain is the position at the terminal end of the chain. The second position is immediately adjacent to the first position.

The term "LAB" means a mixture of linear alkylbenzenes which comprises a benzene ring appended to any carbon atom of a substantially linear $C_{10}$-$C_{14}$ alkyl chain.

The term "base number" or "BN" refers to the amount of base equivalent to milligrams of KOH in one gram of sample. Thus, higher BN numbers reflect more alkaline products, and therefore a greater alkalinity reserve. The BN of a sample can be determined by ASTM Test No. D2896 or any other equivalent procedure.

The term "overbased alkaline earth alkylaryl sulfonate" refers to a composition comprising a diluent (e.g., lubricating oil) and an alkylaryl sulfonate, alkyltolyl sulfonate or alkylxylyl sulfonate, wherein additional alkalinity is provided by a stoichiometric excess of an alkaline earth metal base, based on the amount required to react with the acidic moiety of the sulfonate. Enough diluent should be incorporated in the overbased sulfonate to ensure easy handling at safe operating temperatures.

The term "low overbased alkylaryl sulfonate" refers to an overbased alkaline earth alkylaryl sulfonate having a BN of about 2 to about 60.

The term "high overbased alkaline earth sulfonate" refers to an overbased alkaline earth alkylaryl sulfonate having a BN of 250 or more. Generally a carbon dioxide treatment is required to obtain high BN overbased detergent compositions. It is believed that this forms a colloidal dispersion of metal base.

Unless otherwise specified, all percentages are in weight percent, all ratios are molar ratios, and all molecular weights are number average molecular weights.

Description of $C_{14}$ to $C_{40}$ Linear Olefin

The $C_{14}$ to $C_{40}$ linear olefins can be a mixture of olefins, cut preferably to mixtures of $C_{14}$-$C_{16}$, $C_{16}$-$C_{18}$, $C_{20}$-$C_{22}$, $C_{20}$-$C_{24}$, $C_{24}$-$C_{28}$, $C_{26}$-$C_{28}$, $C_{30+}$ linear groups, advantageously these mixtures are coming from the polymerization of ethylene. These particular cuts can be further blended to create distinct blend of different carbon number cuts within the desired range. Preferably, these linear olefins contain a high degree of N-alpha olefin typically greater than 70% by weight and typically greater than 80% often approaching 90% by weight.

Linear olefins derived from the ethylene chain growth process are predominantly alpha olefins. This process yields even numbered straight chain 1-olefins from a controlled Ziegler polymerization. Non-Ziegler ethylene chain growth oligomerization routes are also known in the art. Other methods for preparing the alpha olefins of this invention include wax cracking as well as catalytic dehydrogenation of normal paraffins. However, these latter processes typically require further processing techniques to provide a suitable alpha olefin carbon distribution. The procedures for the preparation of alpha olefins are well known to those of ordinary skill in the art and are described in detail under the heading "Olefins" in the Encyclopedia of Chemical Technology, Second Edition, Kirk and Othmer, Supplement, Pages 632-657, Interscience Publishers, Div. of John Wiley and Son, 1971, which is hereby incorporated by reference.

Advantageously, the linear olefins are mainly linear alpha olefin cuts, such as those marketed by Chevron Phillips Chemical Company under the names of Normal alpha olefin $C_{20}$-$C_{24}$ or Normal alpha olefin $C_{26}$-$C_{28}$ by British Petroleum under the name of Normal $C_{20}$-$C_{26}$ olefin, by Shell Chemicals under the name SHOP (Shell Higher Olefin Process) $C_{20}$-$C_{22}$ also referred to as NEODENE™, or as mixture of these cuts, or olefins from these companies having from about 16 to 28 carbon atoms.

Mono Alkyl Substituted Tolyl or Xylyl Sulfonate

The first of the two ingredients in the composition of the mixtures which are the object of the present invention, in a preponderant proportion with respect to the second is a mono alkyl substituted tolyl or xylyl sulfonate wherein the linear mono alkyl substituent derived from a linear olefin, as previously defined, must be attached to the tolyl or xylyl ring in a proportion equal or higher than 15% in position 1 or 2 of the linear alkyl chain. Thus stated in another fashion the tolyl or xylyl group is attached to the primary or secondary carbon of the linear aliphatic alkyl group. Preferably the first component, is present in from about 50 to 90% by weight of a mono $C_{14}$ to $C_{40}$ linear alkyl substituted tolyl or xylyl sulfonate, wherein from 15 to 30 mole % of the tolyl or xylyl ring is attached on positions 1 or 2 of the linear alkyl chain Alkylation for these mono $C_{14}$ to $C_{40}$ linear alkyl substituted tolyl or xylyl sulfonates are carried out in a single alkylation reactor where a large molar excess of aromatic is used with respect to the linear olefin, routinely up to 10:1 and wherein the mole % of the aryl radical fixed on position 1 or 2 of the linear alkyl chain is higher or equal to 15%, ranging typically from about 15% to about 30%, preferably from about 18% to 25%, and even more preferably from about 20% to about 25%. The alkylation reaction is effected conventionally with Friedel and Craft catalysts, such as HF and $AlCl_3$ for example, or with zeolite catalysts.

Heavy Alkyl Aryl Sulfonates Derived from Alkylation of Benzene Linear Olefin

The heavy alkyl benzene sulfonate is derived from the alkylation of benzene with $C_{10}$ to $C_{14}$ linear olefins; thus, it can be a dialkyl benzene sulfonate, a monoalkyl benzene or mixtures of dialkyl benzene sulfonate and monoalkyl benzene sulfonate. The monoalkyl benzene is derived from the dimerization of the linear olefin. The starting linear olefin typically contains at least 70 mol % of linear alpha olefin and preferably about 90 mol %. Although normal alpha olefins can employed, typically the linear olefins result from the dehydration of linear paraffins. These paraffins commonly are produced by the extraction of straight chain hydrocarbons from a hydrotreated kerosene boiling range petroleum fraction. As stated above, the heavy alkyl benzene sulfonate is derived from linear olefins, thus the number of carbon atoms in the monoalkyl benzene sulfonate, and similarly the sum of the two linear alkyl groups in the dialkyl benzene sulfonate, is between 16 and 40, and preferably between 18 and 38, and more preferably between 20 and 28 carbon atoms.

These heavy dialkyl aryl sulfonates can be obtained in a plurality of ways and thus not restricted to the following. One multi-step method consists by first affecting the synthesis of the corresponding mono alkyl aryl hydrocarbon wherein the linear mono alkyl radical has the shortest chain length of carbon atoms, followed by the alkylation of this hydrocarbon by a linear olefin containing at least a number of carbon atoms which is sufficient to satisfy the ranges indicated hereinabove. Another method consists of a direct alkylation of an aromatic carbide by a mixture of linear alpha olefins from $C_8$ to $C_{40}$ in an aromatic carbide/olefin mole ratio close to 0.5, in order to obtain a dialkyl aryl hydrocarbon wherein the sum of the carbon atoms of the two linear alkyl chains satisfies the aforementioned definition. Another method consists of dimerizing the linear olefin followed by subsequent alkylation and sulfonation.

Commercially, heavy benzene sulfonate derived from alkylation of benzene with $C_{10}$ to $C_{14}$ linear olefins are produced as a byproduct in the production of linear alkylbenzene sulfonates (LABS) commonly used as household laundry detergents. The petrochemical industries standard process is to produce LAB by dehydrogenating $C_{10}$ to $C_{14}$ linear paraffins to linear olefins and then mono alkylating benzene with the linear olefins in the presence of HF (less common aluminum chloride) alkylation catalysts. Other suitable alkylation catalysts are known in the art. The production is directed to produce mono linear $C_{10}$ to $C_{14}$ alkylbenzene which is separated by distillation from a heavy fraction, as stated above, the light fraction is routinely used in household detergents after sulfonation and caustic neutralization. The heavy fraction is a by-product commonly referred to as "LAB Bottoms" or "heavy of LAB", mainly consists of dialkyl benzenes substituted in the para and meta positions, and of certain heavy mono alkyl benzenes resulting from the oligo-polymerization of the initial linear olefin. LAB bottoms could also be obtained by alkylation of benzene by a mixture of partially dehydrogenated linear paraffin. Typically LAB Bottoms is a mixture of the monoalkylates and dialkylates, which if desired, could be further fractionated into the monoalkylates and dialkylates, as well as the individual species therein. Typically, such fractionation is not required and preferably the heavy alkyl benzene is a mixture of from 30 to 80 weight % mono alkylate benzene (from the dimerization of the starting linear olefin) and 70 to 30 weight % dialkyl alkylate benzene (primarily para and meta substituted and preferably with the para isomer as the predominate dialkyl species). Preferred molecular weights of these compositions have a molecular weight of from about 350 to about 400.

Optionally, the "LAB Bottoms" and/or alkyl benzene sulfonate derived from alkylation of benzene with $C_{10}$ to $C_{14}$ linear olefins may contain a minor amount (less than 5 wt %) of the mono linear $C_{10}$ to $C_{14}$ alkylbenzene product (LAB not removed during distillation), and preferably less than 3 wt % and more preferably less than 1 wt % of this composition.

Procedure for Preparation of Alkyl Aryl Sulfonates

An aspect of this invention is methods for preparing such a mixture of alkyl aryl sulfonates as defined herein. Various methods are known in the art, see U.S. Pat. No. 4,764,295. A first method comprises the mixing of the corresponding alkyl aryl hydrocarbons, the sulfonation of the mixture, and the reaction of the resulting sulfonic acids with an excess of alkaline earth base. A second method of invention comprises the sulfonation of the mixed alkylates and their reaction with an excess of alkaline earth metal. A third method of the invention consists of separately preparing each of the alkyl aryl sulfonates used in the composition of the mixtures and their mixing in the requisite proportions. The first method is generally preferred because the sulfonates obtained usually exhibit better solubility in lubricating oils that the sulfonates obtained by the other two methods.

One such method for obtaining the detergent mixture of the present invention is further outlined herein below in steps A through D.

A. Mono $C_{14}$ to $C_{40}$ linear alkyl substituted tolyl or xylyl sulfonate, wherein from 15 to 30 mole % of the tolyl or xylyl ring is attached on positions 1 or 2 of the linear alkyl chain. Alkylation of substituted phenyl (toluene for example) by a linear alpha olefin which contains a conventional molar proportion of about 80% of alpha olefin.

A large molar excess up to 10:1 of aromatic versus linear alpha olefin is used. The catalyst used for the Friedel and Craft reaction is preferably selected from hydrofluoric acid, aluminum chloride, boron fluoride, a sulfonic ion exchange resin, an acid activated clay and a zeolite. The conditions of this alkylation reaction depend on the type of Friedel and Craft catalyst used.

If the catalyst is hydrofluoric acid, the temperature is preferably between 20 and 70° C. and the pressure between atmospheric pressure and $10\times10^5$ Pa.

If the catalyst is aluminum chloride or boron fluoride, these conditions are the ones described in the literature concerning this reaction.

Finally, if a solid Friedel and Craft catalyst is used, such as a sulfonic ion exchange resin or an acid-activated clay, the temperature of the alkylation reaction is between 40 and 250° C., and the pressure is between atmospheric pressure and $15\times10^5$ Pa.

If a zeolite is utilized, the alkylation reaction is typically carried out at process temperatures ranging from about 1001C to about 250° C.

The process is carried out without the addition of water. As the olefins have a high boiling point, the process is preferably carried out in the liquid phase. The alkylation process may be carried out in batch or continuous mode. In the batch mode, a typical method is to use a stirred autoclave or glass flask, which may be heated to the desired reaction temperature. A continuous process is most efficiently carried out in a fixed bed process. Space rates in a fixed bed process can range from 0.01 to 10 or more weight hourly space velocity. In a fixed bed process, the alkylation catalyst is charged to the reactor and activated or dried at a temperature of at least 150° C. under vacuum or flowing inert, dry gas. After activation, the alkylation catalyst is cooled to ambient temperature and a flow of the aromatic hydrocarbon compound is introduced, optionally toluene. Pressure is increased by means of a back pressure valve so that the pressure is above the bubble point pressure of the aromatic hydrocarbon feed composition at the desired reaction temperature. After pressurizing the system to the desired pressure, the temperature is increased to the desired reaction temperature. A flow of the olefin is then mixed with the aromatic hydrocarbon and allowed to flow over the catalyst. The reactor effluent comprising alkylated aromatic hydrocarbon, unreacted olefin and excess aromatic hydrocarbon compound are collected. The excess aromatic hydrocarbon compound is then removed by distillation, stripping, evaporation under vacuum, or any other means known to those skilled in the art.

Suitable zeolite catalysts are known in the art; they may be formed naturally and may also be prepared synthetically. Synthetic zeolites include, for example, zeolites A, X, Y, L and omega. Other materials, such as boron, gallium, iron or germanium, may also be used to replace the aluminum or silicon in the framework structure. A particularly preferred zeolite is produced by the process comprising: contacting a zeolite Y with a binder in the presence of volatiles to form a mixture wherein the weight percent of zeolite Y is in the range of about 40 to about 99 percent based on the total dry weight of the resulting catalyst composite, and wherein the volatiles in the mixture are in the range of about 30 weight percent to about 70 weight percent of the mixture; (b)shaping the mixture to form a composite; (c) drying the composite; and (d) calcining the composite in a substantially dry environment. Other preferred alkylation catalysts comprise having a zeolite structure type selected from BEA, MOR, MTW and NES. Such zeolites include mordenite, ZSM-4, ZSM-12, ZSM-20, offretite, and gmelinite. Of the above, mordenite is preferred. In particular, to catalysts having a macropore structure comprising mordenite zeolite having a silica to alumina molar ratio in the range of about 50:1 to about 105:1 and wherein the peak macropore diameter of the catalyst, measured by ASTM Test No. D 4284-03, is less than or equal to about 900 angstroms, and the cumulative pore volume at pore diameters less than or equal to about 500 angstroms, measured by ASTM Test No. D 4284-03, is less than or equal to about 0.30 milliliters per gram, preferably at pore diameters less than or equal to about 400 angstroms less than about 0.30 milliliters per gram, and more preferably at pore diameters less than or equal to about 400 angstroms in the range of about 0.05 milliliters per gram to about 0.18 milliliters per gram.

It is presumed that the alpha olefin reactors with the Friedel and Craft catalyst to form an intermediate carbonium ion, which is isomerized, even more easily if the relative proportion of alpha olefin is higher. The alkylation of this carbonium ion takes place by an aromatic electrophilic substitution reaction, wherein a hydrogen atom of the benzene is substituted by a carbon atom from the linear olefinic chain.

Particularly preferred $C_{14}$ to $C_{40}$ linear olefins are obtained by oligo-polymerization of ethylene, and which contain between 14 and 40, preferably between 16 and 30, and more particularly between 20 and 24 carbon atoms, and wherein the molar proportion of mono alpha olefin is at least 70%. Specific examples of linear olefins answering to this definition are provided by $C_{16}$ and $C_{18}$ olefins, $C_{14}$ to $C_{16}$, $C_{14}$ to $C_{18}$ and $C_{20}$ to $C_{24}$ olefin cuts, or by combinations of a plurality of these. The $C_{14}$ to $C_{40}$ linear mono alpha olefins obtained by direct oligo-polymerization of ethylene, have an infrared absorption spectrum which exhibits an absorption peak at 908 $cm^{-1}$, characteristic of the presence of an ethylene double bond at the end of the chain, on the carbon atoms occupying positions 1 and 2 of the olefin: also distinguished therein are two other absorption peaks at wavelengths of 991 and 1641 $cm^{-1}$.

The aryl hydrocarbons with which these linear olefins are reacted can be aromatic hydrocarbons substituted by at least one methyl radical and in particular toluene, xylene and in particular ortho-xylene because they favor the mono alkylation by the linear mono olefin according to the Friedel Craft reaction due to the presence of the substituents already present on the aromatic ring.

B. Heavy alkyl benzene sulfonate is derived from the alkylation of benzene with $C_{10}$ to $C_{14}$ linear olefins has been described previously. Particularly preferred heavy alkyl benzene sulfonate are the commercially prepared Heavy of LAB.

C. Sulfonic acid

The next step of the sulfonation of each of the alkyl aromatic hydrocarbons or of the mixture of the different alkyl aromatic hydrocarbons corresponding to the mixture of the invention is effected by methods known in themselves, for example by reacting the product of the alkylation step, with concentrated sulfuric acid, with an oleum, with sulfur trioxide dilute in nitrogen or air, or with sulfur trioxide dissolved in sulfur dioxide. This sulfonation reaction can also be effected by contacting the ingredients (alkylate and sulfur trioxide) in the form of a falling film in streams of the same or opposite directions. After sulfonation, the acid or the different sulfonic acids obtained can be purified by conventional methods, such as washing with water or by thermal treatment with stirring by nitrogen bubbling (see, for example, the method described in French Patent No. 9311709 to the Applicant).

D. Alkyl aryl sulfonate

The next step of the sulfonic acid or acids with an excess of alkaline earth base can be affected by the addition of an oxide or a hydroxide of alkaline earth metal, such as magnesium, calcium, barium, and particularly lime.

This neutralization step is carried out in a dilution oil with an alcohol with a boiling point higher than 80° C. and preferably with a carboxylic acid containing 1 to 4 carbon atoms, in the presence of water, as described in particular in U.S. Pat. No. 4,764,295 incorporated herein by reference in its entirety.

Among the alcohols with boiling points higher than 80° C., linear or branched aliphatic mono alcohols are preferably selected, containing 4 to 10 carbon atoms, such as isobutanol, 2-ethyl hexanol and $C_8$ to $C_{10}$ oxo alcohols.

Among the carboxylic acids which can be used are preferably formic acid, acetic acid and their mixtures.

Among the dilution oils which are suitable for the neutralization step, are the paraffinic oils such as 100 Neutral oil, as well as naphthenic or mixed oils.

After the water and/or alcohol are removed, the solid matter is removed by filtration, and the alkyl aryl sulfonate or sulfonates of alkaline earth metal obtained are collected.

If the corresponding alkyl aryl hydrocarbons or the corresponding sulfonic acids have not already been mixed, the alkyl aryl sulfonates can be mixed at this stage to obtain the mixtures of the invention in the desired proportions.

The mixtures of alkyl aryl sulfonates of the invention are preferably weakly super alkalinized, that is their base No BN, measured according to Standard ASTM-D-2896, can range from 3 to 60, preferably 10 to 40, but also from 5 to 20, and they can be used in particular is detergent/dispersant agents for lubricating oils.

The mixtures of alkyl aryl sulfonates of the invention are particularly advantageous if their base No is low and corresponds to a range of BN between 10 and 40.

It is worthwhile to mention that the low BN alkyl aryl sulfonate could be prepared with and without chloride ions. Therefore, the detergent mixture of alkyl aryl sulfonates of alkaline earth metals of this invention can be prepared essentially free of chloride ions.

EXAMPLES

The invention will be further illustrated by following examples, which set forth particularly advantageous method embodiments. While the examples are provided to illustrate the present invention, the are not intended to limit it.

These examples contain a number of test results, obtained by the following methods of measurements.

Viscosity at 100° C. in CST

The viscosity is measured at the temperature of 100° C. after dilution of the product sample to be measured in 100 N oil, until a solution is obtained having a total calcium content of 2.35% by weight. If the product to be measured has a total calcium content lower than 2.35% by weight, the viscosity is measured without dilution, following method ASTM D 445.

Compatibility

Storage stability test: a) main objective of the test: to evaluate the stability in storage of the lubricating oil composition; b) implementation of the test: the product is stored in tubes at 80° C. for a period of 15 days. A deposit means the product is not stable and its utilization in lube additives is not recommended. At the end of this period, if no deposit appears, the product is considered as a "stable product" for storage at high temperature and classified "pass". If some deposit appears, the product is considered as a "non stable product" for storage at high temperature and classified as "fail".

Appearance a) main objective: to evaluate the appearance of the product if stored at room temperature. The appearance is classified by comparison with references. b) Implementation of the test: the product is examined in tube at room temperature: a clear and bright product is desired. Classification "pass" if the appearance of the product is clear and bright. Classification "fail" if the appearance of the product is light cloud or moderate cloud.

Appearance in 10% 600 N after 15 days-10 g of the product is dissolved in 600 Neutral diluent oil under agitation at 80° C. The quantity of 600 Neutral diluent oil in such a solution of 100 g is obtained, so the concentration is 10% wt in diluent oil. The test evaluates appearance as: bright (1), light cloud (2), moderate cloud (3). A product is usable if lube additive only if the appearance is clear and bright, in this case, it is classified "pass". If any cloud appears, it is classified "fail".

Example 1

Preparation of alkylates—the alkylate is a mixture of 80% alkyltoluene and 20% of heavy of LAB.

A) Alkylation of toluene with Normal alpha olefins was carried out as described below.

A fixed bed reactor constructed from 15.54 millimeters internal diameter schedule 160 stainless steel pipe was used for this alkylation test. Pressure in the reactor was maintained by an appropriate back pressure valve. The reactor and heaters were constructed so that adiabatic temperature control could be maintained during the course of alkylation runs. A 192 gram bed of 850 micrometers to 2 millimeters Alundum particles was packed in the bottom of the reactor to provide a pre-heat-zone. Next, 100 grams of Zeolite Y Catalyst Composite 12, which is described herein below, was charged to the fixed bed reactor. The reactor was gently vibrated during loading to give a maximum packed bulk density of catalyst in the reactor. Finally, void spaces in the catalyst bed were filled with 351 grams 150 micrometers Alundum particles as interstitial packing.

The reactor was then closed, sealed, and pressure tested under nitrogen. Next the alkylation catalyst was dehydrated during 15 hours at 200° C. under a 20 liters per hour flow of nitrogen measured at ambient temperature and pressure and then cooled to 100° C. under nitrogen. Toluene was then introduced into the catalytic bed in an up-flow manner at a flow rate of 195 grams per hour. Temperature (under adiabatic temperature control) was increased to a start-of-run temperature of 170° C. (measured just before the catalyst bed) and the pressure was increased to 10 atmospheres.

When temperature and pressure has lined out at desired start-of-run conditions of 170° C. and 10 atmospheres, a feed mixture, consisting of toluene and $C_{20-24}$ NAO at a molar ratio of 10:1 and dried over activated alumina, was introduced in an up-flow manner. As the feed reached the catalyst in the reactor, reaction began to occur and internal catalyst bed temperatures increased above the inlet temperature. After about 8 hours on-stream, the reactor exotherm was 20° C. At 26 hours on-stream, the olefin conversion in the product was 99.1%. The run was stopped after 408 hours on-stream, although the run could have continued. At this time, the olefin conversion was 99.45%.

Alkylated aromatic hydrocarbon products containing excess toluene were collected during the course of the run. After distillation to remove excess aromatic hydrocarbon, analysis showed that greater than 99% conversion of olefin was achieved during the course of the run.

The 1 or 2-tolyl-eicosane ($C_{20}$) isomer corresponds to the longest retention time because it is known from the literature that the isomers having the alkyl group furthest from the end of the alkyl chain have the shortest retention time and that for the same number of carbons. In the present trial, 20% of the aryl group are fixed on the carbon 1 or 2. The remaining (80%) of the aryl group are fixed on the other carbon.

Zeolite Y Catalyst Composite 12—Loss-on-ignition (LOI) was determined for a sample of a commercially available zeolite Y CBV 760® available from Zeolyst International by heating the sample to 538° C. for 1 hour. The LOI obtained provided the percent volatiles in the zeolite Y batch being used. Volatiles of the zeolite powder and alumina powder were 12.24 weight % and 23.89 weight %, respectively. Corresponding amounts of zeolite and alumina powders were 1185.1 grams and 341.6 grams, respectively. The final weight % of the nitric acid of the dry weight of the zeolite and the alumina in this preparation was 0.75% and 12.9 grams of nitric acid was dissolved in 300 grams of deionized water. The powders were mixed in a plastic bag for 5 minutes and then mixed in the Baker Perkins mixer for 5 minutes. Additional deionized water, 619.7 grams, was added to the mixture over 20 minutes. The acid solution was pumped in over 8 minutes with continued mixing. Mixing was continued for an additional 40 minutes. At this time, the mixture was still a powder. After 3 hours of mixing, an additional 50 grams of deionized water was added to the mixture. After 3½ hours of mixing, an additional 25 grams of deionized water was added to the mixture and another 15 grams of deionized water was added to the mixture after 4 hours and 4¼ hours of mixing. After 4 hours and 55 minutes of mixing, the volatiles were 45.2 weight %. The wet mix was extruded, dried, and sized. The extrudates were calcined in a substantially dry environment in a muffle furnace according to the following temperature program: The extrudates were heated at full power to 593° C. Temperature overshoot was avoided. Next, the extrudates were held at 593° C. for one hour and cooled to 149° C. Mercury Intrusion Porosimetry showed the peak macropore diameter to be 900 angstroms and the cumulative pore volume at diameters less than 300 angstroms to be 0.144 ml/gram.

B) Heavy alkyl benzene derived from the alkylation of benzene with $C_{10}$ to $C_{14}$ linear olefin Description of "heavy of LAB" 1-A commercial material called "heavy of LAB" and coming from the heavies obtained during the production of LAB alkylation of benzene by $C_{10}$-$C_{14}$ olefin and having the following analyses.

Viscosity at 100° C.: 4.27 $mm^2/s$, molecular weight (number)=355. By gas chromatography, the level of "LAB" coming from the starting olefin (C10-C14) are measured and was less than 1%. The infra-red indicated:

40.8% mono alkylates (coming from the polymerization of the starting $C_{10}$-$C_{14}$ olefins), 34.5% para dialkyl 24.7% meta dialkyl Such a commercial alkylate is obtained during the production of "LAB" obtained by the alkylation of benzene by linear olefin $C_{10}$-$C_{14}$ in presence of hydrofluoric acid or aluminum chloride with a large molar excess of toluene versus olefin around (10:1).

After separation by distillation of benzene and the light fraction, the "LAB" fraction having an alkyl chain from C10-C14 is obtained. The "heavy of LAB" being the heaviest part.

Sulfonation

The alkylate coming from a mixture of 80% alkyltoluene and 20% "Heavy of LAB" described in this example was sulfonated by a cocurrent stream of sulfur trioxide ($SO_3$) and air with a tubular reactor (2 meters long and1 centimeter inside diameter) in a down flow mode using the following conditions: Reactor temperature was 60° C., $SO_3$ flow rate was 73 grams per hour, alkylate flow rate 327 grams per hour at a $SO_3$ to alkylate molar ratio of 1.05. The $SO_3$ was generated by passing a mixture of oxygen and sulfur dioxide ($SO_2$) through a catalytic furnace containing vanadium oxide ($V_2O_5$).

The crude mixture of alkylaryl sulfonic acid was diluted with 10 weight % 100 neutral diluent oil based on the total weight of the crude alkylaryl sulfonic acid and placed in a four liter-neck glass reactor fitted with a stainless steel mechanical agitator rotating at between 300 and 350 rpm, a condenser and a gas inlet tube (2 millimeters inside diameter) located just above the agitator blades for the introduction of nitrogen gas. The contents of the reactor was heated to 110° C. with stirring and nitrogen gas was bubbled through the mixture between 30-40 liters per hour under vacuum for between about 30 minutes to one hour until the weight % of $H_2SO_4$ is less than about 0.3 weight % base on the total weight of the product.

This final alkylaryl sulfonic acid (80% alkyltoluene and 20% "Heavy of LAB") has the following properties based on the total weight of the product: weight % of $HSO_3$ and weight % of $H_2SO_4$ are reported in TABLE 1.

The sulfonic acid obtained in the previous step was converted into a low overbased sulfonates. In this step, relative molar proportions of $Ca(OH)_2$ and sulfonic acid obtained in preceding step are reacted in order to obtain a proportion of around 30-50% of lime non neutralized by sulfonic acid in the final product. This proportion of 30-50% of non neutralized lime makes it possible to obtain a BN of about 20 in the final sulfonate, according to standard ASTM D 2896.

To achieve this, a quantity of $Ca(OH)_2$ is added which does not correspond to stoichiometric neutralization of the quantity of sulfonic acid reacted, that is 0.5 mole of $Ca(OH)_2$ per mole of this sulfonic acid, but an excess of $Ca(OH)_2$ is added with respect to the stoichiometric quantity, that is a proportion of 0.73 mole of $Ca(OH)_2$ per mole sulfonic to obtain a BN of about 20. The conditions of reaction used are those described in U.S. Pat. No. 4,764,925.

Example 2

The starting alkylate is a mixture of the same alkylates as Example 1 but the proportion are different 60/40 weight instead of 80/20.

Sulfonic acid and the corresponding sulfonates are done following the same process as Example 1; operating conditions and analyses are described in Table 1.

Example 3

The starting alkylate is a mixture of the same alkyltoluene as Example 1 but another "Heavy of LAB" called "Heavy of LAB" 2 having the following analyses were utilized.

Viscosity at 100° C.: 4,78 mm2/s, molecular weight (number)=380. By gas chromatography, the level or "LAB" coming from the starting olefin ($C_{10}$-$C_{14}$) is around 2.9%. The infra-red indicated:

69% monoalkylates (coming from the polymerization of the starting $C_{10}$-$C_{14}$ olefins), 20% para-dialkyl benzene 11% meta-dialkyl benzene Sulfonic acid and the corresponding sulfonates are done following the same process as Example 1. Operating conditions and analyses are described in Table 1.

Example 4

This example is similar to Example 1 except the alkylation of toluene with Normal alpha olefins $C_{20}$-$C_{24}$ is done in presence of HF as catalyst instead of a "fixed bed".

The alkylate is synthesized in a continuous alkylation Pilot plant with hydrofluoric acid (as catalyst). It consists in one reactor of 1.125 liter and a 15 liter settler wherein the organic phase is separated from the phase containing the hydrofluoric acid, all the equipment being maintained under a pressure of about $3.5\times10^5$ Pa. The charge molar ratio: toluene/olefin is 10:1. The volume ratio hydrofluoric acid/olefin is 1:1. The residential time is 6 minutes and the temperature: 64° C.

The organic phase is withdrawn via a valve and expanded to atmospheric pressure and the toluene is removed by topping that is heating to 200° C. at atmospheric pressure.

Sulfonation—The alkylate coming from a mixture of 80% of the above alkyltoluene and 20% of "heavy of LAB" described in Example 1 was sulfonated in similar conditions as Example 1. Operating conditions and analyses are described in Table 1.

Comparative Examples

Comparative Example A

A) Alkylation

The starting alkylate is a mixture of same alkyltoluene (80%) as Example 1 but the second alkylate is different. It is described in U.S. Pat. No. 6,204,226 as branched monoalkylbenzene in which the branched mono alkylsubstituent contains from 14 to 18 carbon atoms, it is obtained through the following step.

The alkylate is synthesized in a continuous alkylation Pilot plant with hydrofluoric acid (as catalyst). It consists in one reactor of 1.125 liter and a 15 liter settler wherein the organic phase is separated from the phase containing the hydrofluoric acid, all the equipment being maintained under a pressure of about $3.5\times10^5$ Pa. The organic phase is then withdrawn via a valve and expanded to atmospheric pressure and the benzene is removed by topping, that is heating to 160° C. at atmospheric pressure. As the target is to have predominantly a monoalkylate, there is always a large molar excess of benzene around 10:1.

The ratio of hydrofluoric acid to the olefin by volume is 1:1. In this case, the starting olefin is a heavy propylene oligomer (which molecular weight is from 196 to 256). So a light fraction is produced during the catalytic alkylation reaction, and this fraction must be removed, just like the excess of benzene, on a vacuum distillation column. Light fraction means any alkylbenzene having an alkyl chain lower than $C_{13}$. To remove such a light fraction, the final distillations are as follows:

temperature at top of column: 262° C.

temperature at bottom of column: 302° C.

pressure: 187×102 Pa (187 mbar)

B) Sulfonation of a mixture of 80% alkyltoluene of Example 1 and 20% monoalkylbenzene in which the branched mono alkylsubstituent contains from $C_{14}$ to $C_{18}$ carbon atoms (see Example 1). Operating conditions and analyses are described in Table 2.

Comparative Example B

The starting alkylates are a mixture of the same alkyltoluene as Example 1 and a second alkylate called "Heavy bottom of BAB". This last alkylate is synthesized in a continuous alkylation Pilot with hydrofluoric acid (as catalyst). It consists in one reactor of 1.125 liter and a 15 liter settler wherein the organic phase is separated from the phase containing the hydrofluoric acid, all the equipment being maintained under a pressure of about 3.5×105 Pa. A large molar excess of benzene versus the olefin (here propylene tetramer) is utilized, and the ratio hydrofluoric acid to the olefin by volume is 1:1.

The organic phase is then withdrawn via a valve and expanded to atmospheric pressure and the benzene is removed by topping. There is a second column, the light fraction (alkylate having an alkyl chain lower than $C_{11}$) is removed and in the last column, BAB mono alkylbenzene wherein the branched alkyl chain is from $C_{11}$ to $C_{13}$ is removed at the top; the product at the bottom of the column is called "heavy bottoms of BAB". It is a branched material.

Monoalkyl benzene is from 30 to 60% wt para-dialyl benzene is from 25 to 50% wt meta-dialkyl benzene is from 12 to 25% wt Molecular weight from 310 up to 355. The material used in this example has 37% mono, 47% para dialkyl, 16% meta dialkyl and the molecular weight is 330.

Comparative example B is the following mixture: 80% alkyltoluene (of Example 1) and 20% heavy bottoms of BAB Sulfonation and obtaining of alkylsulfonate are done in the conditions described in Example 1. Operating conditions and analyses are described in Table 2.

Comparative Examples C and D

Here, the predominant alkylate utilized is a mono linear alkylbenzene having the aromatic fixed in a molar proportion comprised between 0 and 13% (preferably between 5 and 11%) in position 1 or 2 of the linear alkyl chain and wherein the alkyl chain is a linear chain that contains between 14 and 40 (preferably 20 to 24 carbon atoms).

Synthesize of this Linear Monoalkylbenzene

The alkylate is synthesized in an alkylation pilot plant with hydrofluoric acid which consists in two reactors in series of 1.125 liters each and a 15 liter settler wherein the organic phase is separated from the phase containing the hydrofluoric acid, all the equipment being maintained under a pressure of about $5\times10^5$ Pa.

The benzene/olefin molar ratio is relatively in the first reactor 1.2:1 and it is higher in the second reactor about 6:1.

Furthermore, the ratio of hydrofluoric acid to the olefin by volume is 1:1. In the first reactor and 1.5:1 in the second reactor, the residential is 6 minutes in each reactor and the temperature: 64° C.

There is no formation of a light fraction. Hence it is sufficient to effect a topping of the unreacted benzene to obtain the corresponding alkylate.

The mixtures of alkylate which make up Comparative Examples C and D are depicted in Table A

TABLE A

| Formulation data | | | |
|---|---|---|---|
| | | Heavy of LAB | |
| | Alkylbenzene | 2 | 1 |
| Comparative Example C | 80 | 20 | |
| Comparative Example D | 80 | | 20 |

Sulfonation and obtaining the alkylsulfonate are done in the conditions described in Example 1. Operating conditions and analyses are described in Table 2

TABLE 1

| | TEST | | | | | | | |
|---|---|---|---|---|---|---|---|---|
| | 1 | | 2 | | 3 | | 4 | |
| Alkylation | | | | | | | | |
| Aromatic | toluene | commercial alkylate | toluene | commercial alkylate | toluene | commercial alkylate | toluene | commercial alkylate |
| linear olefin | C20-C26 | | C20-C26 | | C20-C26 | | C20-C26 | |
| branched olefin | | | | | | | | |
| catalyst | fixed bed Y zeolite | | fixed bed Y zeolithe | | fixed bed Y zeolithe | | HF | |
| aromatic/olefin (mol) | 10 | | 10 | | 10 | | 10 | |
| Analyses of alkylate | | LAB1 | | LAB1 | | LAB2 | | LAB1 |
| Molecular weight | 400 | 355 | 400 | 355 | 400 | 380 | 405 | 355 |
| Positions 1 + 2 (mole) | | | | | | | | |
| Σ position (mole) | 0.22 | | 0.22 | | 0.22 | | 0.2 | |
| conditions for obtention alkylate | toluene topping | benzene + light + LAB removals | toluene topping | benzene + light + LAB removals | toluene topping | benzene + light + LAB removals | toluene topping | |
| viscosity at 40° C. | 19.1 | 22.3 | 19.1 | 22.3 | 19.1 | 26.9 | 19.5 | 22.3 |
| % weight of alkylate | 80 | 20 | 60 | 40 | 80 | 20 | 80 | 20 |
| Characteristics of corresponding mixture of alkylates, acids and sulfonates | | | | | | | | |
| Analysis of alkylate Positions 1 + 2 (mol) | | | | | | | | |
| Σ positions of the 2 alkyaltes | 0.176 | | 0.132 | | 0.176 | | 0.176 | |
| CMR $SO_3$/alkylates | 0.95 | | 1.05 | | 0.95 | | 1.05 | |
| Analyses of the acid | | | | | | | | |
| % $HSO_3^-$ (weight) | 12.39 | | 13.77 | | 12.4 | | 12.5 | |
| % $H_2SO_4$(weight) | 0.06 | | 0.17 | | 0.15 | | 0.2 | |
| Analysis of the sulfonate | | | | | | | | |
| % CaT (weight) | 2.62 | | 2.69 | | 2.52 | | 2.49 | |
| % CaS (weight) | 1.73 | | 1.72 | | 1.75 | | 1.65 | |
| BN (ASTM D 2896) | 22 | | 23 | | 18 | | 20 | |
| Viscosity at 100° C. at 2.35% CaT ($mm^2/s$) | 24 | | 19 | | 31 | | 28 | |
| % crude sediment | 0.6 | | 0.2 | | 1 | | 0.6 | |
| % filtered sediment | 0.02 | | 0.02 | | 0.02 | | 0.01 | |
| Filtration rate ($Kg/h/m^2$) | 1000 | | 3000 | | 750 | | 1600 | |
| Stability at 80° C. (15 days) | pass | | pass | | pass | | pass | |
| Appearance as it | pass | | pass | | pass | | pass | |
| Appearance (10% 600 N) | pass | | pass | | pass | | pass | |

TABLE 2

| | Comparative Example | | | | | | | |
|---|---|---|---|---|---|---|---|---|
| | A | | B | | C | | D | |
| alkylation | | | | | | | | |
| aromatic | toluene | benzene | toluene | benzene | benzene | commercial alkylate | benzene | commercial alkylate |
| linear olefin | C20-C26 | | C20-C26 | | C20-C26 | | C20-C26 | |
| branched olefin | | C15-C18 | | C12 | | | | |
| catalyst | fixed bed Y zeolithe | HF | fixed bed Y zeolithe | HF | HF | | HF | |
| aromatic/olefin (mol) | | | | | | | | |
| first reactor | 10 | 10 | 10 | 10 | 1.2 | | 1.2 | |
| second reactor | | | | | 4.8 | | 4.8 | |
| Total | 10 | 10 | 10 | 10 | 6 | | 6 | |
| Analysis of the alkylate | | | | | | LAB2 | | LAB1 |
| molecular weight | 400 | 280 | 400 | 330 | 405 | 380 | 405 | 355 |
| position 1 + 2 (mol) | | | | | | | | |
| Σ position (mol) | 0.22 | | 0.22 | | 0.11 | | 0.11 | |
| conditions for obtention alkylate | toluene topping | benzene + light removals | toluene topping | benzene + light + BAB removal | benzene topping | | benzene topping | |
| viscosity at 40° C. | 19.1 | 15.4 | 19.1 | 29.2 | 18 | 26.9 | 18 | 22.3 |
| % weight of alkylate | 80 | 20 | 80 | 20 | 80 | 20 | 80 | 20 |
| Characteristics of corresponding mixtures of alkylates, acids and sulfonates | | | | | | | | |
| Analyse of the alkylate position 1 + 2 (mol) | | | | | | | | |
| Σ positions of the 2 alkylates | 0.176 | | 0.176 | | 0.08 | | 0.088 | |
| CMR ($SO_3$/alkylates) | 1.05 | | 1.05 | | 0.95 | | 0.95 | |
| Analyses of the acid | | | | | | | | |
| % $HSO_3^-$ (wt) | 14.52 | | 14.14 | | 11.9 | | 12.81 | |
| % $H_2SO^4$ (wt) | 0 | | 0.31 | | 0.19 | | 0.15 | |
| Analyses of the sulfonates | | | | | | | | |
| % CaT (wt) | 2.43 | | 2.58 | | 2.58 | | 2.64 | |
| % CaS (wt) | 1.76 | | 1.76 | | 1.73 | | 1.78 | |
| BN (ASTM D 2896) | 17 | | 19 | | 19.7 | | 20.8 | |
| Viscosity at 100° C. at 2.35% Ca ($mm^2/s$) | 35 | | 19.9 | | 21.7 | | 19.4 | |
| % crude sediment | 1 | | 0.8 | | 0.4 | | 0.3 | |
| % filtered sediment | 0.04 | | 0.02 | | 0.04 | | 0.02 | |
| filtration rate ($kg/h/m^2$) | 500 | | 122 | | 1285 | | 1135 | |
| stability at 80° C. (15 days) | Fail | | Fail | | Fail | | Fail | |
| appearance as it (15 days) | Fail | | Fail | | Fail | | Fail | |
| appearance (10% 600 N) (15 days) | Fail | | Fail | | Fail | | Fail | |

What is claimed is:

1. A detergent mixture of alkyl aryl sulfonates of alkaline earth metals comprising:

a) 50 to 90% by weight of a mono $C_{14}$ to $C_{40}$ linear alkyl substituted tolyl or xylyl sulfonate, wherein from 15 to 30 mole % of the tolyl or xylyl ring is attached on positions 1 or 2 of the linear alkyl chain; and b) 10 to 50% by weight of a heavy alkyl benzene sulfonate derived from alkylation of benzene with $C_{10}$ to $C_{14}$ linear olefins, wherein the heavy alkyl benzene sulfonate is selected from:

i) dialkyl benzene sulfonate, ii) monoalkyl benzene sulfonate, wherein the alkyl substituent is derived from the dimerization of the linear olefin, and iii) mixtures of i) and ii), wherein the base No. BN of said mixture as measured according to Standard ASTM-D-2896 is from 3 to 60.

2. The detergent mixture according to claim 1, wherein the linear alkyl chain as defined in component a) contains from 16 to 30 carbon atoms.

3. The detergent mixture according to claim 2, wherein the linear alkyl chain as defined in component a) contains from 20 to 24 carbon atoms.

4. The detergent mixture according to claim 1, wherein the substituted tolyl or xylyl sulfonate as defined in component a) is a tolyl sulfonate.

5. The detergent mixture according to claim 1, wherein the substituted tolyl or xylyl sulfonate as defined in component a) is a xylyl sulfonate.

6. The detergent mixture according to claim 5, wherein the xylyl sulfonate is ortho xylyl sulfonate.

7. The detergent mixture according to claim 1, wherein in component a) from 18 to 25 mole % of the tolyl or xylyl ring is attached on positions 1 or 2 of the linear alkyl chain.

8. The detergent mixture according to claim 1 wherein the heavy alkyl benzene sulfonate as defined in component b) is derived from the alkylation of benzene with $C_{11}$ to $C_{13}$ linear olefins.

9. The detergent mixture according to claim 1 wherein the heavy alkyl benzene sulfonate as defined in component b) has an average molecular weight from 350 to 400.

10. The detergent mixture according to claim 1 wherein the heavy alkyl benzene sulfonate as defined in component b) is a dialkyl benzene sulfonate.

11. The detergent mixture according to claim 1 wherein the heavy alkyl benzene sulfonate as defined in component b) is a monoalkyl benzene sulfonate.

12. The detergent mixture according to claim 1 wherein the heavy alkyl benzene sulfonate as defined in component b) is a mixture of dialkyl benzene sulfonate and monoalkyl benzene sulfonate.

13. The detergent mixture according to claim 1 wherein the heavy alkyl benzene sulfonate as defined in component b) is produced as a byproduct in the production of $C_{10}$ to $C_{14}$ linear alkylbenzenes.

14. The detergent mixture according to claim 13 wherein the heavy alkyl benzene sulfonate as defined in component b) further comprises less than 5% by weight of a mono $C_{10}$ to $C_{14}$ linear alkyl benzene sulfonate.

15. The detergent mixture according to claim 14 wherein the heavy alkyl benzene sulfonate as defined in component b) further comprises less than 3% by weight of a mono $C_{10}$ to $C_{14}$ linear alkyl benzene sulfonate.

16. The detergent mixture according to claim 14 wherein the heavy alkyl benzene sulfonate as defined in component b) further comprises less than 1% by weight of a mono $C_{10}$ to $C_{14}$ linear alkyl benzene sulfonate.

17. The detergent mixture according to claim 1 wherein said mixture contains from 80 to 60% by weight of component a) and from 20 to 40% by weight of component b).

18. The detergent mixture according to claim 1 wherein said mixture is essentially free of chloride ions.

19. The detergent mixture according to claim 1, wherein the base No. BN of said mixture as measured according to Standard ASTM-D-2896 is from 10 to 40.

20. The detergent mixture according to claim 1, wherein the alkaline earth metal is calcium.

21. A lubricating oil composition comprising: a major amount of an oil of lubricating viscosity; and a detergent mixture of alkyl aryl sulfonates of alkaline earth metals comprising:

a) 50 to 90% by weight of a mono $C_{14}$ to $C_{40}$ linear alkyl substituted tolyl or xylyl sulfonate, wherein from 15 to 30 mole % of the tolyl or xylyl ring is attached on positions 1 or 2 of the linear alkyl chain; and b) 10 to 50% by weight of a heavy alkyl benzene sulfonate derived from alkylation of benzene with $C_{10}$ to $C_{14}$ linear olefins, wherein the heavy alkyl benzene sulfonate is selected from:

i) dialkyl benzene sulfonate, ii) monoalkyl benzene sulfonate, wherein the alkyl substituent is derived from the dimerization of the linear olefin, and iii) mixtures of i) and ii), wherein the base No. BN of said mixture as measured according to Standard ASTM-D-2896 is from 3 to 60.

22. The detergent mixture according to claim 1, wherein the $C_{14}$ to $C_{40}$ linear alkyl substituent of the mono $C_{14}$ to $C_{40}$ linear alkyl substituted tolyl or xylyl sulfonate is derived from normal alpha olefins.

23. The lubricating oil composition according to claim 21, wherein the $C_{14}$ to $C_{40}$ linear alkyl substituent of the mono $C_{14}$ to $C_{40}$ linear alkyl substituted tolyl or xylyl sulfonate is derived from normal alpha olefins.

* * * * *